US012304027B2

(12) United States Patent
Tabuchi et al.

(10) Patent No.: US 12,304,027 B2
(45) Date of Patent: May 20, 2025

(54) GRINDING APPARATUS AND USE METHOD OF GRINDING APPARATUS

(71) Applicant: DISCO CORPORATION, Tokyo (JP)

(72) Inventors: Tomotaka Tabuchi, Tokyo (JP); Yuannan Li, Tokyo (JP); Kazuma Sekiya, Tokyo (JP)

(73) Assignee: DISCO CORPORATION, Tokyo (JP)

( * ) Notice: Subject to any disclaimer, the term of this patent is extended or adjusted under 35 U.S.C. 154(b) by 1381 days.

(21) Appl. No.: 16/896,397

(22) Filed: Jun. 9, 2020

(65) Prior Publication Data

US 2020/0391337 A1 Dec. 17, 2020

(30) Foreign Application Priority Data

Jun. 17, 2019 (JP) ..... 2019-111905

(51) Int. Cl.

| | |
|---|---|
| ***B24B 7/22*** | (2006.01) |
| ***B24B 7/04*** | (2006.01) |
| ***B24B 7/06*** | (2006.01) |
| ***B24B 7/20*** | (2006.01) |
| ***B24B 41/02*** | (2006.01) |
| ***B24B 41/06*** | (2012.01) |

(52) U.S. Cl.

CPC ..... *B24B 7/228* (2013.01); *B24B 7/04* (2013.01); *B24B 7/06* (2013.01); *B24B 7/20* (2013.01); *B24B 41/02* (2013.01); *B24B 41/06* (2013.01)

(58) Field of Classification Search

None

See application file for complete search history.

(56) References Cited

U.S. PATENT DOCUMENTS

2020/0391337 A1* 12/2020 Tabuchi ..... B24B 7/20

FOREIGN PATENT DOCUMENTS

| | | | |
|---|---|---|---|
| JP | 2003059872 | A | 2/2003 |
| JP | 2013255952 | A | 12/2013 |
| JP | 2015080834 | A | 4/2015 |

OTHER PUBLICATIONS

Office Action issued in counterpart Japanese patent application No. 2019-111905, dated Mar. 14, 2023.

* cited by examiner

*Primary Examiner* — Long Pham

(74) *Attorney, Agent, or Firm* — GREER BURNS & CRAIN, LTD.

(57) ABSTRACT

A grinding apparatus includes a first chuck table that has a porous holding surface corresponding to a first wafer and holds the first wafer, a second chuck table that has a porous holding surface corresponding to a second wafer different from the first wafer in size or shape and holds the second wafer, and a grinding unit that grinds, by a grinding wheel, the first wafer sucked and held by the first chuck table positioned at the grinding position or the second wafer sucked and held by the second chuck table positioned at the grinding position.

3 Claims, 7 Drawing Sheets

GRINDING APPARATUS AND USE METHOD OF GRINDING APPARATUS

BACKGROUND OF THE INVENTION

Field of the Invention

The present invention relates to a grinding apparatus that grinds a wafer and a use method of a grinding apparatus for grinding a wafer by using the grinding apparatus.

Description of the Related Art

A wafer on which a device such as an integrated circuit (IC) or a large scale integration (LSI) is formed on the front surface side of each of plural regions marked out by planned dividing lines (streets) is divided along the planned dividing lines. Thereby, plural device chips each having the device are manufactured. This device chip is mounted in various pieces of electronic equipment typified by mobile phones, personal computers, and so forth.

In recent years, along with reduction in the size and thickness of electronic equipment, reduction in the thickness has been required also for the device chip. Thus, a method is used in which a wafer is thinned by executing grinding processing for the back surface side of the wafer before the wafer is divided. For the grinding processing of the wafer, a grinding apparatus including a chuck table (holding table) having a holding surface that holds the wafer and a grinding unit to which a grinding wheel having grinding abrasive stones for grinding the wafer is mounted is used (for example, refer to Japanese Patent Laid-open No. 2013-255952). The wafer is held by the holding surface of the chuck table and the back surface side of the wafer held by the chuck table is ground by grinding surfaces of the grinding abrasive stones fixed to the grinding wheel. Thereby, the wafer is thinned.

SUMMARY OF THE INVENTION

The above-described grinding apparatus is used for processing of wafers with various sizes and shapes. For example, silicon wafers with various diameters (6 inches, 8 inches, 12 inches, and so forth) are used in a manufacturing process of semiconductor device chips and the grinding apparatus grinds these silicon wafers. Furthermore, the chuck table included in the grinding apparatus is designed according to the size and shape of the wafer. Thus, in the case of grinding plural kinds of wafers with different sizes and shapes by the grinding apparatus, the chuck table needs to be replaced according to the kind of wafer. However, the replacement of the chuck table requires many kinds of work such as attachment and detachment of the chuck table, angle adjustment of the rotation axis of the chuck table, and shape correction of the holding surface of the chuck table for aligning the holding surface and the grinding surfaces of the grinding abrasive stones parallel to each other. In addition, these kinds of work need to be executed by a skilled worker. For this reason, a lot of labor and time are spent for the replacement work of the chuck table. Furthermore, when the kind of wafer processed by the grinding apparatus is changed, the operation of the grinding apparatus needs to be stopped each time and the above-described replacement work of the chuck table needs to be executed. As a result, the processing efficiency of the wafer lowers.

The present invention is made in view of such a problem and intends to provide a grinding apparatus capable of reducing the frequency of replacement of the chuck table and a use method of the grinding apparatus.

In accordance with an aspect of the present invention, there is provided a grinding apparatus including a first chuck table that has a porous holding surface corresponding to a first wafer and holds the first wafer, a second chuck table that has a porous holding surface corresponding to a second wafer different from the first wafer in size or shape and holds the second wafer, and a turntable that supports each of the first chuck table and the second chuck table in a rotatable state and positions the first chuck table to a conveyance position to which the first wafer is conveyed and a grinding position at which the first wafer is ground and positions the second chuck table to the conveyance position to which the second wafer is conveyed and the grinding position at which the second wafer is ground. The grinding apparatus includes also a grinding unit that grinds, by a grinding wheel, the first wafer sucked and held by the first chuck table positioned at the grinding position or the second wafer sucked and held by the second chuck table positioned at the grinding position and a cover that covers the first chuck table positioned at the grinding position, the second chuck table positioned at the grinding position, and the grinding wheel in grinding of the first wafer or the second wafer and is connected to an exhaust duct.

In accordance with another aspect of the present invention, there is provided a use method of a grinding apparatus that grinds a wafer. The grinding apparatus includes a first chuck table that has a porous holding surface corresponding to a first wafer and holds the first wafer, a second chuck table that has a porous holding surface corresponding to a second wafer different from the first wafer in size or shape and holds the second wafer, and a turntable that supports each of the first chuck table and the second chuck table in a rotatable state and positions the first chuck table to a conveyance position to which the first wafer is conveyed and a grinding position at which the first wafer is ground and positions the second chuck table to the conveyance position to which the second wafer is conveyed and the grinding position at which the second wafer is ground. The grinding apparatus includes also a grinding unit that grinds, by a grinding wheel, the first wafer sucked and held by the first chuck table positioned at the grinding position or the second wafer sucked and held by the second chuck table positioned at the grinding position and a cover that covers the first chuck table positioned at the grinding position, the second chuck table positioned at the grinding position, and the grinding wheel in grinding of the first wafer or the second wafer and is connected to an exhaust duct. The use method includes a wafer preparation step of preparing the first wafer and the second wafer, a first chuck table covering step of conveying the first wafer onto the first chuck table positioned at the conveyance position and covering the holding surface of the first chuck table by the first wafer, and a second wafer grinding step of, after execution of the first chuck table covering step, conveying the second wafer onto the second chuck table positioned at the conveyance position and grinding the second wafer held by the second chuck table positioned at the grinding position by the grinding unit and then conveying the second wafer from the second chuck table positioned at the conveyance position.

Preferably, the second wafer grinding step is executed a plurality of times in a state in which the holding surface of the first chuck table is covered by the first wafer. Furthermore, preferably, the first wafer that covers the holding surface of the first chuck table and does not become a target of processing by the grinding unit and the second wafer that is held by the second chuck table and is ground by the grinding unit are prepared in the wafer preparation step. Moreover, preferably, the first wafer has a size and a shape that allow covering of the holding surface of the second chuck table.

The grinding apparatus according to the aspects of the present invention includes the first chuck table that holds the first wafer and the second chuck table that holds the second wafer different from the first wafer in size or shape. Due to this, plural kinds of wafers can be processed without executing replacement work of the chuck table and the frequency of replacement of the chuck table is reduced.

The above and other objects, features and advantages of the present invention and the manner of realizing them will become more apparent, and the invention itself will best be understood from a study of the following description and appended claims with reference to the attached drawings showing a preferred embodiment of the invention.

DETAILED DESCRIPTION OF THE PREFERRED EMBODIMENT

Figure 1:
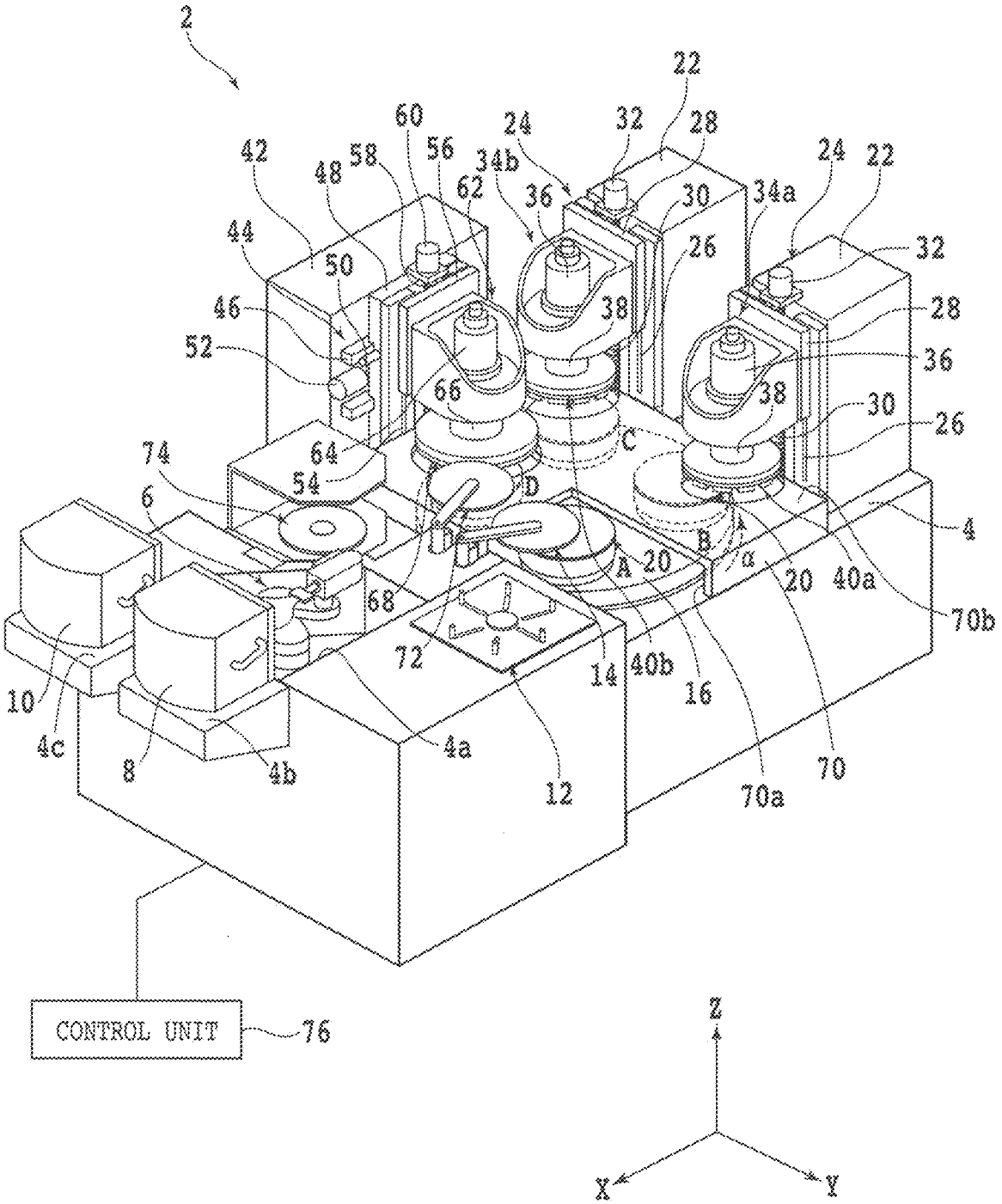
FIG. 1 is a perspective view illustrating a grinding apparatus.

An embodiment of the present invention will be described below with reference to the accompanying drawings. First, a configuration example of a grinding apparatus according to the present embodiment will be described. FIG. 1 is a perspective view illustrating a grinding apparatus 2.

The grinding apparatus 2 includes a base 4 that supports the respective constituent elements configuring the grinding apparatus 2. An opening 4*a* is formed on the front end side of the upper surface of the base 4 and a conveyance unit (conveyance mechanism) 6 that conveys a workpiece or the like to be processed by the grinding apparatus 2 is disposed inside this opening 4*a*. Furthermore, in a region on the front side of the opening 4*a*, a cassette placement pedestal 4*b* on which a cassette 8 is placed and a cassette placement pedestal 4*c* on which a cassette 10 is placed are disposed.

Figure 2:
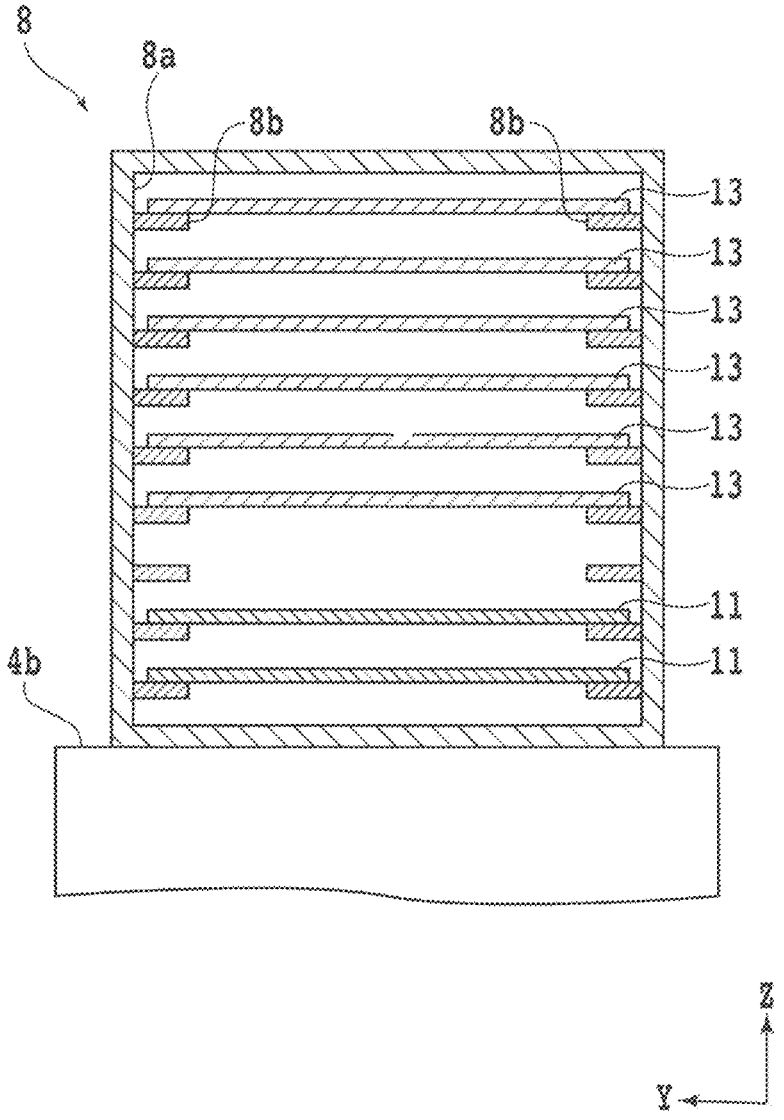
FIG. 2 is a sectional view illustrating a cassette.

FIG. 2 is a sectional view illustrating the cassette 8. The cassette 8 is formed into a rectangular parallelepiped box shape, for example, and has an opening part 8*a* that is open toward the conveyance unit 6 (see FIG. 1) when the cassette 8 is placed on the cassette placement pedestal 4*b*. Inside this opening part 8*a*, pairs of guide rails 8*b* that support the peripheral part of a wafer 11 or a wafer 13 are disposed at plural stages. Plural wafers 11 and plural wafers 13 are housed in this cassette 8.

The wafer 11 is a wafer for covering that covers a chuck table 18 (see FIG. 3) to be described later when the wafer 13 is held by a chuck table 20 (see FIG. 3) to be described later and is processed. Details of a use method of the wafer 11 will be described later.

On the other hand, the wafer 13 is a silicon wafer formed into a circular disc shape, for example, and is equivalent to a wafer scheduled to be processed by the grinding apparatus 2 (wafer before processing). Furthermore, for example, the wafer 13 is segmented into plural regions by plural planned dividing lines (streets) arranged in a lattice manner to intersect each other, and a device such as an IC or LSI is formed on the front surface side of each of these regions. By dividing the wafer 13 along the planned dividing lines, plural device chips each including the device are manufactured. Furthermore, the device chips with reduced thickness are allowed to be obtained by executing grinding processing and polishing processing for the back surface side of the wafer 13 before dividing by the grinding apparatus 2 and thinning the wafer 13. There is no limit to the material, size, shape, structure, and so forth of the wafer 13. For example, the wafer 13 may be formed of a material such as a semiconductor other than silicon (GaAs, InP, GaN, SiC, or the like), glass, ceramic, resin, or metal. Furthermore, the devices do not have to be formed on the wafer 13.

The wafers 11 and the wafers 13 are each housed in the cassette 8 in the state in which the peripheral part is supported by the pair of guide rails 8*b*. In FIG. 2, an example in which two wafers 11 and six wafers 13 are housed is illustrated. The cassette 8 in which the wafers 11 and the wafers 13 are housed is placed on the cassette placement pedestal 4*b*. Furthermore, the wafer 11 or 13 is drawn out from the cassette 8 and is conveyed by the conveyance unit 6 illustrated in FIG. 1. Although the configuration example of the cassette 8 is described here, the cassette 10 can also be configured similarly to the cassette 8. In the cassette 10, wafers after processing by the grinding apparatus 2 (processed wafers) and so forth are housed.

A position adjustment mechanism (alignment mechanism) 12 is disposed on the obliquely rear side of the opening 4*a*. The wafer (wafer 11, 13, or the like) housed in the cassette 8 is conveyed to the position adjustment mechanism 12 by the conveyance unit 6. Then, the position adjustment mechanism 12 disposes the wafer with adjustment to a predetermined position.

A conveyance unit (conveyance mechanism, loading arm) 14 that holds a wafer and pivots is disposed at a position adjacent to the position adjustment mechanism 12. The conveyance unit 14 includes, on the lower surface side thereof, a suction adhesion pad that causes suction adhesion of the upper surface side of a wafer, and holds the wafer 11 for which position adjustment has been executed by the position adjustment mechanism 12 by suction adhesion by the suction adhesion pad and conveys the wafer 11 to the rear side.

A turntable 16 with a circular disc shape is disposed on the rear side of the conveyance unit 14. The turntable 16 is coupled to a rotational drive source (not illustrated) such as a motor and rotates around a rotation axis substantially parallel to a Z-axis direction (vertical direction, upward-downward direction). Furthermore, plural chuck tables that hold a wafer are disposed on the turntable 16.

Figure 3:
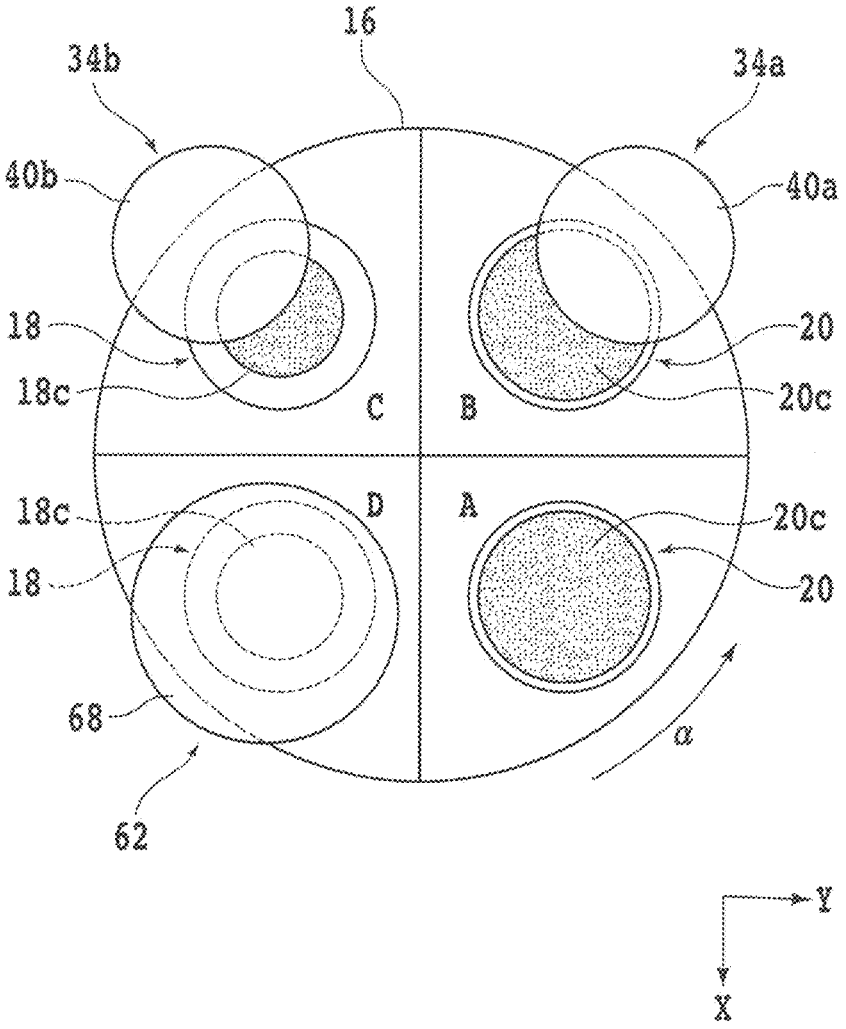
FIG. 3 is a plan view illustrating plural chuck tables supported by a turntable.

FIG. 3 is a plan view illustrating plural chuck tables supported by the turntable 16. The turntable 16 supports two chuck tables (holding tables) 18 that can hold a first wafer and two chuck tables (holding tables) 20 that can hold a second wafer different from the first wafer in size or shape. In FIG. 3, an example is illustrated in which one chuck table 18, the other chuck table 18, one chuck table 20, and the other chuck table 20 are sequentially disposed at substantially equal intervals along the circumferential direction of the turntable 16. However, there is no limit to the number of chuck tables disposed on the turntable 16.

The turntable 16 rotates in an anticlockwise manner in plan view (in a direction illustrated by an arrow $\alpha$) and positions the respective chuck tables 18 and 20 to a conveyance position A, a first grinding position (coarse grinding position) B, a second grinding position (finishing grinding position) C, a polishing position D, and the conveyance position A in that order. Furthermore, the chuck tables 18 and 20 are each coupled to a rotational drive source (not illustrated) such as a motor and each rotate around a rotation axis substantially parallel to the Z-axis direction. That is, the turntable 16 supports each of the chuck tables 18 and 20 in a rotatable state.

The conveyance unit 14 illustrated in FIG. 1 conveys a wafer disposed on the position adjustment mechanism 12 onto the chuck table 18 or the chuck table 20 positioned at the conveyance position A. In the following, as one example, description will be made about the case in which the wafer 11 (see FIG. 2) is held by the chuck table 18 as the first wafer and the wafer 13 (see FIG. 2) is held by the chuck table 20 as the second wafer.

Figure 4A:
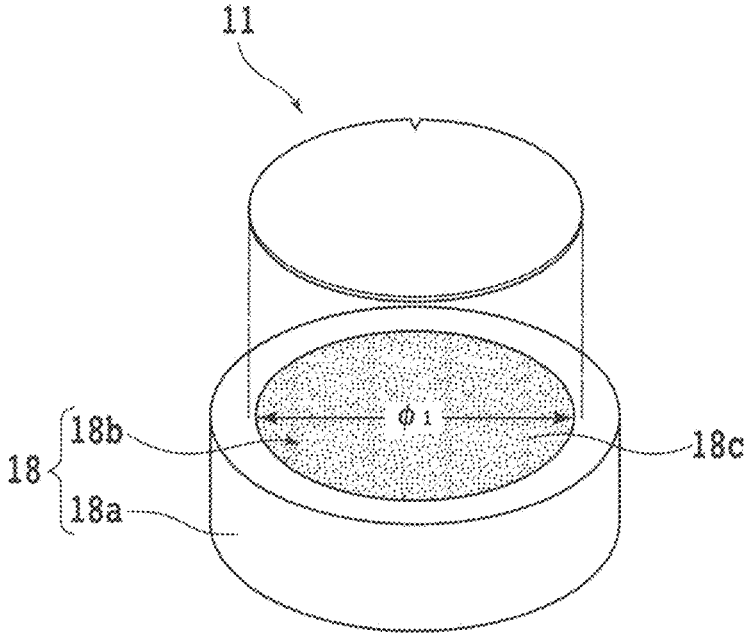
FIG. 4A is a perspective view illustrating a first chuck table.

FIG. 4A is a perspective view illustrating the chuck table 18. The chuck table 18 includes a frame body 18*a* with a circular column shape and a porous member 18*b* that is mounted on the upper surface side of the frame body 18*a* and has a circular disc shape. The porous member 18*b* is formed of porous ceramic or the like and is fitted into a circular recessed part formed on the upper surface side of the frame body 18*a*. The upper surface of the porous member 18*b* forms a holding surface 18*c* that holds the first wafer (wafer 11) and has porosity. The holding surface 18*c* is formed corresponding to the wafer 11. Specifically, the holding surface 18*c* is formed into size and shape with which the whole of the holding surface 18*c* is covered by the wafer 11 when the wafer 11 is disposed on the chuck table 18. For example, when the wafer 11 has a circular disc shape, the holding surface 18*c* is formed into a circular shape whose diameter $\varphi_1$ is equal to or smaller than the diameter of the wafer 11. In FIG. 4A, the case in which the diameter $\varphi_1$ of the holding surface 18*c* is slightly smaller than the diameter of the wafer 11 is illustrated. The holding surface 18*c* of the chuck table 18 is connected to a suction source (not illustrated) through a flow path (not illustrated) formed inside the chuck table 18. When a negative pressure of the suction source is caused to act on the holding surface 18*c* in the state in which the wafer 11 is disposed on the chuck table 18 to cover the whole of the holding surface 18*c*, the wafer 11 is sucked and held by the chuck table 18.

Figure 4B:
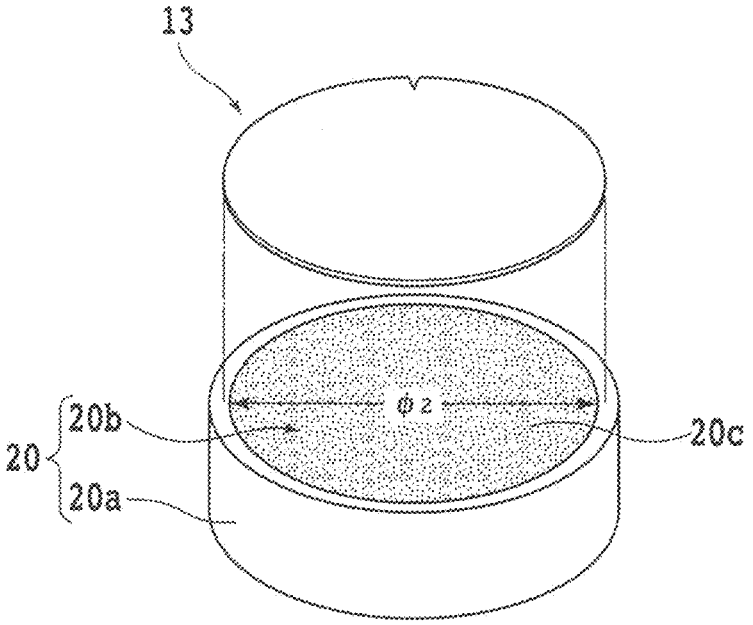
FIG. 4B is a perspective view illustrating a second chuck table.

FIG. 4B is a perspective view illustrating the chuck table 20. The chuck table 20 includes a frame body 20*a* with a circular column shape and a porous member 20*b* that is mounted on the upper surface side of the frame body 20*a* and has a circular disc shape. The porous member 20*b* is formed of porous ceramic or the like and is fitted into a circular recessed part formed on the upper surface side of the frame body 20*a*. The upper surface of the porous member 20*b* forms a holding surface 20*c* that holds the second wafer (wafer 13) and has porosity. The holding surface 20*c* is formed corresponding to the wafer 13. Specifically, the holding surface 20*c* is formed into size and shape with which the whole of the holding surface 20*c* is covered by the wafer 13 when the wafer 13 is disposed on the chuck table 20. For example, when the wafer 13 has a circular disc shape, the holding surface 20*c* is formed into a circular shape whose diameter $\varphi_2$ is equal to or smaller than the diameter of the wafer 13. In FIG. 4B, the case in which the diameter $\varphi_2$ of the holding surface 20*c* is slightly smaller than the diameter of the wafer 13 is illustrated. The holding surface 20*c* of the chuck table 20 is connected to a suction source (not illustrated) through a flow path (not illustrated) formed inside the chuck table 20. When a negative pressure of the suction source is caused to act on the holding surface 20*c* in the state in which the wafer 13 is disposed on the chuck table 20 to cover the whole of the holding surface 20*c*, the wafer 13 is sucked and held by the chuck table 20.

The chuck table 18 and the chuck table 20 are configured to be capable of holding wafers different in size or shape. Specifically, the diameter $\varphi_1$ of the holding surface 18*c* of the chuck table 18 is smaller than the diameter $\varphi_2$ of the holding surface 20*c* of the chuck table 20 ($\varphi_1<\varphi_2$). Thus, the chuck table 18 can hold a wafer (for example, wafer 11) whose diameter is smaller than the wafer held by the chuck table 20 (for example, wafer 13).

As illustrated in FIG. 1, a column-shaped support structure 22 is disposed on each of the rear side of the first grinding position B and the rear side of the second grinding position C (on the rear side of the turntable 16). Furthermore, Z-axis movement mechanisms 24 are disposed on the front surface side of the support structures 22. The Z-axis movement mechanism 24 includes a pair of Z-axis guide rails 26 disposed substantially in parallel to the Z-axis direction and a plate-shaped Z-axis moving plate 28 is mounted to the pair of Z-axis guide rails 26 in a slidable state. A nut part (not illustrated) is disposed on the rear surface side (back surface side) of the Z-axis moving plate 28 and a Z-axis ball screw 30 disposed substantially in parallel to the Z-axis guide rails 26 is screwed to this nut part. Furthermore, a Z-axis pulse motor 32 is coupled to one end part of the Z-axis ball screw 30. When the Z-axis ball screw 30 is rotated by the Z-axis pulse motor 32, the Z-axis moving plate 28 moves in the Z-axis direction along the Z-axis guide rails 26.

A grinding unit 34*a* that executes coarse grinding of a wafer is disposed on the front surface side (turntable 16 side) of the Z-axis moving plate 28 disposed above the first grinding position B. Meanwhile, a grinding unit 34*b* that executes finishing grinding of a wafer is disposed on the front surface side (turntable 16 side) of the Z-axis moving plate 28 disposed above the second grinding position C. Movement of the grinding units 34*a* and 34*b* in the Z-axis direction is controlled by the Z-axis movement mechanisms 24.

The grinding units 34*a* and 34*b* each include a circular cylindrical housing 36 mounted to the Z-axis moving plate 28. A spindle 38 that configures a rotation axis and has a circular cylindrical shape is housed in the housing 36 in a rotatable state and a lower end part (tip part) of the spindle 38 is exposed from the housing 36.

A grinding wheel 40*a* for executing the coarse grinding of a wafer is mounted to the lower end part of the spindle 38 included in the grinding unit 34*a*. Furthermore, a grinding wheel 40*b* for executing the finishing grinding of a wafer is mounted to the lower end part of the spindle 38 included in the grinding unit 34*b*. The grinding wheels 40*a* and 40*b* each include a base that is composed of a metal such as aluminum or stainless steel and has a circular ring shape. On the lower surface side of this base, plural grinding abrasive stones with a rectangular parallelepiped shape are arranged in a ring manner along the outer circumference of the base.

For example, the grinding abrasive stones are formed by fixing abrasive grains composed of diamond, cubic boron nitride (cBN), or the like by a binder such as a metal bond, resin bond, or vitrified bond. There is no limit to the material, shape, structure, size, and so forth of the grinding abrasive stones and the numbers of grinding abrasive stones that the grinding wheels 40*a* and 40*b* have can also be arbitrarily set. However, the average grain size of the abrasive grains of the grinding abrasive stones that the grinding wheel 40*b* has is smaller than the average grain size of the abrasive grains of the grinding abrasive stones that the grinding wheel 40*a* has.

A rotational drive source (not illustrated) such as a motor is connected to the upper end side (base end side) of the spindle 38 and the grinding wheels 40*a* and 40*b* rotate by a force transmitted from this rotational drive source. Furthermore, a grinding liquid supply path (not illustrated) for supplying a grinding liquid such as purified water is disposed inside the grinding units 34*a* and 34*b*. The grinding liquid is supplied toward the grinding abrasive stones and a wafer when grinding processing is executed for the wafer.

The grinding unit 34*a* grinds the wafer held by the chuck table 18 or the chuck table 20 positioned at the first grinding position B by the grinding wheel 40*a*. Thereby, coarse grinding processing of the wafer is executed. Furthermore, the grinding unit 34*b* grinds the wafer held by the chuck table 18 or the chuck table 20 positioned at the second grinding position C by the grinding wheel 40*b*. Thereby, finishing grinding processing of the wafer is executed.

A column-shaped support structure 42 is disposed on a lateral side of the polishing position D (on a lateral side of the turntable 16). An XZ-axis movement mechanism 44 is disposed on the face surface side of the support structure 42 (on the side of the turntable 16). The XZ-axis movement mechanism 44 includes a pair of first guide rails 46 disposed substantially in parallel to an X-axis direction (front-rear direction) and a plate-shaped first moving plate 48 is mounted to the pair of first guide rails 46 in a slidable state.

A nut part (not illustrated) is disposed on the back surface side of the first moving plate 48 and a first ball screw 50 disposed substantially in parallel to the first guide rails 46 is screwed to this nut part. Furthermore, a first pulse motor 52 is coupled to one end part of the first ball screw 50. When the first ball screw 50 is rotated by the first pulse motor 52, the first moving plate 48 moves in the X-axis direction along the first guide rails 46.

A pair of second guide rails 54 disposed substantially in parallel to the Z-axis direction are disposed on the face surface side of the first moving plate 48 (on the side of the turntable 16). A plate-shaped second moving plate 56 is mounted to the pair of second guide rails 54 in a slidable state. A nut part (not illustrated) is disposed on the back surface side of the second moving plate 56 and a second ball screw 58 disposed substantially in parallel to the second guide rails 54 is screwed to this nut part. A second pulse motor 60 is coupled to one end part of the second ball screw 58. When the second ball screw 58 is rotated by the second pulse motor 60, the second moving plate 56 moves in the Z-axis direction along the second guide rails 54. Furthermore, a polishing unit 62 that polishes a wafer is disposed on the face surface side of the second moving plate 56 (on the side of the turntable 16). Movement of the polishing unit 62 in the X-axis direction and the Z-axis direction is controlled by the XZ-axis movement mechanism 44.

The polishing unit 62 includes a circular cylindrical housing 64 mounted to the second moving plate 56. A spindle 66 that configures a rotation axis and has a circular cylindrical shape is housed in the housing 64 in a rotatable state and the lower end part of the spindle 66 is exposed from the housing 64. A circular-disc-shaped polishing pad 68 for polishing a wafer is mounted to the lower end part of the spindle 66. Furthermore, a rotational drive source (not illustrated) such as a motor is connected to the upper end side (base end side) of the spindle 66. The polishing pad 68 rotates by a force transmitted from this rotational drive source. Moreover, a polishing liquid supply path (not illustrated) for supplying a polishing liquid is disposed inside the polishing unit 62. The polishing liquid is supplied toward a wafer when polishing processing is executed for the wafer.

The polishing pad 68 includes a polishing layer that gets contact with a wafer and polishes the wafer. The polishing layer is formed by dispersing abrasive grains (fixed abrasive grains) in nonwoven fabric or urethane foam, for example. As the abrasive grains, silica with a grain size of approximately 0.1 to 10 μm can be used, for example. However, the grain size, material, and so forth of the abrasive grains are changed as appropriate according to the material of the wafer and so forth. When the abrasive grains are contained in the polishing layer, the polishing liquid that does not contain abrasive grains is used. As the polishing liquid, an alkaline solution in which sodium hydroxide, potassium hydroxide, or the like is dissolved or an acid liquid of permanganate or the like can be used, for example. Furthermore, it is also possible to use purified water as the polishing liquid. On the other hand, the abrasive grains do not have to be contained in the polishing layer. In this case, a chemical (slurry) in which abrasive grains (loose abrasive grains) are dispersed is supplied as the polishing liquid. The material of the chemical, the material of the abrasive grains, the grain size of the abrasive grains, and so forth are selected as appropriate according to the material of the wafer and so forth.

The polishing unit 62 polishes a wafer held by the chuck table 18 or the chuck table 20 positioned at the polishing position D by the polishing pad 68. Thereby, the polishing processing of the wafer is executed.

Furthermore, a box-shaped cover 70 is disposed on the base 4. The cover 70 has an opening part 70*a* in which the chuck tables 18 and 20 are inserted on the lower surface side thereof and is disposed to cover part of the turntable 16 and the chuck tables 18 and 20 disposed at the first grinding position B, the second grinding position C, and the polishing position D. When the turntable 16 rotates, the chuck tables 18 and 20 are positioned to the first grinding position B, the second grinding position C, and the polishing position D sequentially inside the opening part 70*a* and thereafter are disposed at the conveyance position A. By this cover 70, a processing chamber in which processing of wafers (grinding processing and polishing processing) is executed is defined. Furthermore, on the side of an upper surface 70*b* of the cover 70, plural circular openings into which the grinding wheels 40*a* and 40*b* and the polishing pad 68 are inserted are formed. Due to these openings, contact between the grinding wheels 40*a* and 40*b* and the polishing pad 68 and the cover 70 is avoided. Furthermore, the grinding wheels 40*a* and 40*b* that are grinding wafers and the polishing pad 68 that is polishing a wafer are covered by the cover 70. As a result, scattering of dust generated due to the processing of the wafers (processing dust) and processing liquids (grinding liquid and polishing liquid) is prevented by the cover 70. Furthermore, an exhaust duct for exhausting the gas from the inside (opening part 70*a*) of the cover 70 is connected to the cover 70. By this exhaust duct, the gas (atmosphere), processing dust, mist-like processing liquids, and so forth inside the cover 70 are sucked and removed.

A conveyance unit (conveyance mechanism, unloading arm) 72 that holds a wafer and pivots is disposed at a position adjacent to the conveyance unit 14. The conveyance unit 72 includes, on the lower surface side thereof, a suction adhesion pad that causes suction adhesion of the upper surface side of a wafer, and holds the wafer disposed on the chuck table 18 or the chuck table 20 disposed at the conveyance position A by suction adhesion by the suction adhesion pad and conveys the wafer to the front side. A cleaning unit (cleaning mechanism) 74 that cleans the wafer conveyed by the conveyance unit 72 is disposed on the front side of the conveyance unit 72 and on the rear side of the opening 4*a*. The wafer cleaned by the cleaning unit 74 is conveyed by the conveyance unit 6 and is housed in the cassette 10.

The respective constituent elements that configure the grinding apparatus 2 (conveyance unit 6, position adjustment mechanism 12, conveyance unit 14, turntable 16, chuck tables 18 and 20, Z-axis movement mechanisms 24, grinding units 34*a* and 34*b*, XZ-axis movement mechanism 44, polishing unit 62, conveyance unit 72, cleaning unit 74, and so forth) are each connected to a control unit (control part) 76 formed of a computer or the like. Operation of the respective constituent elements is controlled by the control unit 76.

The above-described grinding apparatus 2 includes plural kinds of chuck tables that can hold wafers different in size or shape. Specifically, in the grinding apparatus 2, the chuck table 18 having the circular holding surface 18*c* whose diameter is $\varphi_1$ and the chuck table 20 having the circular holding surface 20*c* whose diameter is $\varphi_2$ ($\varphi_2>\varphi_1$) are disposed (see FIG. 4A and FIG. 4B). Furthermore, the chuck table 18 can hold the first wafer and the chuck table 20 can hold the second wafer with a larger diameter than the first wafer. Thus, for example, when the wafer processed by the grinding apparatus 2 is changed from the first wafer to the second wafer, the processing of the wafer can be continued through merely switching the chuck table used for holding the wafer from the chuck table 18 to the chuck table 20. Due to this, replacement work of the chuck table becomes unnecessary and improvement in the processing efficiency of the wafer can be intended.

When a wafer with predetermined size and shape is processed by the grinding apparatus 2, one of the chuck tables 18 and 20 suitable for holding the wafer is used and the other of the chuck tables 18 and 20 is not used. For this reason, for example, when a wafer as a processing target is held by the chuck table 20, the holding surface 18*c* of the chuck table 18 (see FIG. 4A) is in an exposed state. When the wafer is processed by the grinding apparatus 2 in this state, processing dust generated due to the processing of the wafer is scattered inside the cover 70 and adheres to the holding surface 18*c* of the chuck table 18 in some cases. Furthermore, the processing dust enters the inside of the chuck table 18 from the holding surface 18*c* and is accumulated inside the chuck table 18 in some cases. If the processing dust adheres to the holding surface 18*c* of the chuck table 18, when another wafer is held by the chuck table 18 subsequently, the state in which the processing dust is sandwiched by the wafer and the holding surface 18*c* is made. This causes inconvenience that the wafer is not held flatly along the holding surface 18*c* or a hollow is formed in a region that gets contact with the processing dust in the wafer, or the like, in some cases. Furthermore, if the processing dust is excessively accumulated inside the chuck table 18, possibly the suction force of the chuck table 18 does not properly act on the wafer.

Thus, when a wafer is processed by the grinding apparatus 2, the wafer as the processing target is held by one of the chuck tables 18 and 20. In addition, the holding surface of the other of the chuck tables 18 and 20 is covered by another wafer. This prevents adhesion of the processing dust to the holding surfaces of the chuck tables 18 and 20 and accumulation of the processing dust inside the chuck tables 18 and 20. A specific example of a use method of the grinding apparatus 2 will be described below. In the following, as one example, the case in which plural wafers 13 (see FIG. 2) are processed by the grinding apparatus 2 will be described. The wafers 13 are ground by the grinding units 34*a* and 34*b* and are polished by the polishing unit 62 in the state of being held by the chuck table 20.

First, the first wafers that cover the holding surfaces 18*c* of the chuck tables 18 (first chuck tables) and the second wafers to be processed in the state of being held by the chuck tables 20 (second chuck tables) are prepared (wafer preparation step). Here, the wafers 11 (see FIG. 2) are used as the first wafers and the wafers 13 (see FIG. 2) are used as the second wafers.

The wafer 11 is a wafer for covering that is formed into size and shape that allow covering of the whole of the holding surface 18*c* of the chuck table 18 and does not become the target of processing by the grinding units 34*a* and 34*b* and the polishing unit 62 (coarse grinding processing, finishing grinding processing, and polishing processing). For example, the wafer 11 is formed into a circular disc shape in such a manner that the diameter thereof is equal to or larger than the diameter $\varphi_1$ of the holding surface 18*c* and is equal to or smaller than the diameter of the frame body 18*a* (see FIG. 4A). Examples of the material of the wafer 11 are the same as the wafer 13. On the other hand, the wafer 13 is equivalent to a workpiece to be processed by the grinding apparatus 2.

The wafers 11 and the wafers 13 are each housed in the cassette 8 (see FIG. 2). The number of wafers 11 housed in the cassette 8 is set equal to or larger than the number of chuck tables 18. On the other hand, there is no limit to the number of wafers 13 housed in the cassette 8. Furthermore, the cassette 8 in which the wafers 11 and the wafers 13 are housed is placed on the cassette placement pedestal 4*b* (see FIG. 1).

Figure 5A:
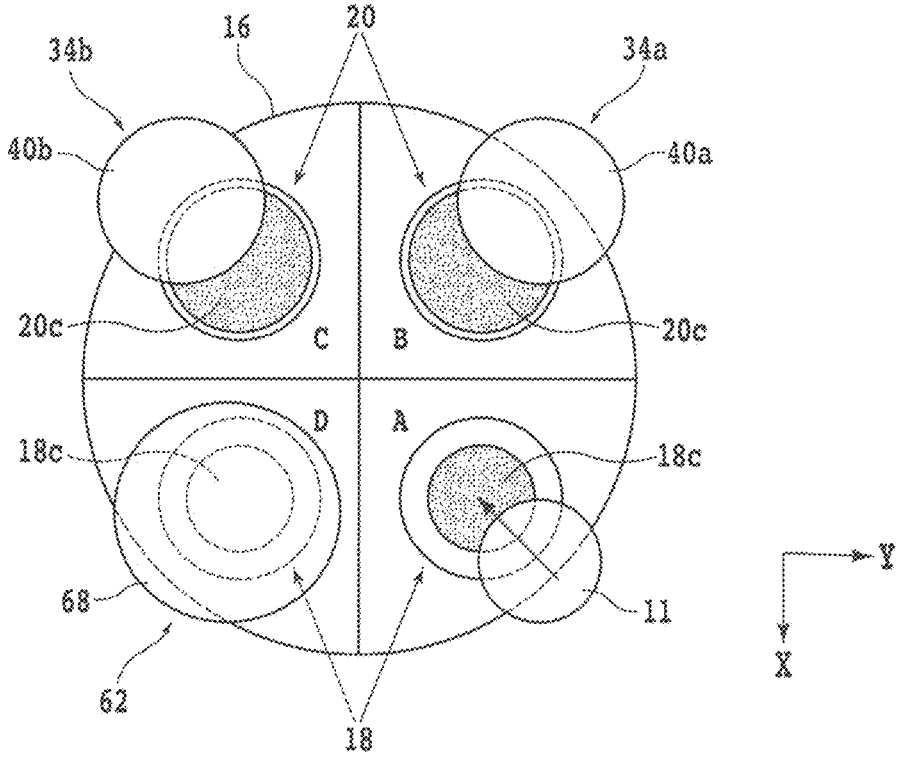
FIG. 5A is a plan view illustrating how a first piece of a wafer is conveyed onto one first chuck table.

Next, the wafers 11 are conveyed onto the chuck tables 18 and the holding surfaces 18*c* of the chuck tables 18 are covered by the wafers 11 (first chuck table covering step). In the first chuck table covering step, first, a first piece of the wafer 11 is conveyed from the cassette 8 to the position adjustment mechanism 12 by the conveyance unit 6 and position adjustment of the first piece of the wafer 11 is executed by the position adjustment mechanism 12. Then, the first piece of the wafer 11 is conveyed from the position adjustment mechanism 12 onto the chuck table 18 disposed at the conveyance position A by the conveyance unit 14 and the first piece of the wafer 11 is held by this chuck table 18. FIG. 5A is a plan view illustrating how the first piece of the wafer 11 is conveyed onto the chuck table 18. The first piece of the wafer 11 is disposed on the chuck table 18 to cover the whole of the holding surface 18*c*. Then, a negative pressure of the suction source is caused to act on the holding surface 18*c* of the chuck table 18 and the first piece of the wafer 11 is sucked and held by the chuck table 18.

Figure 5B:
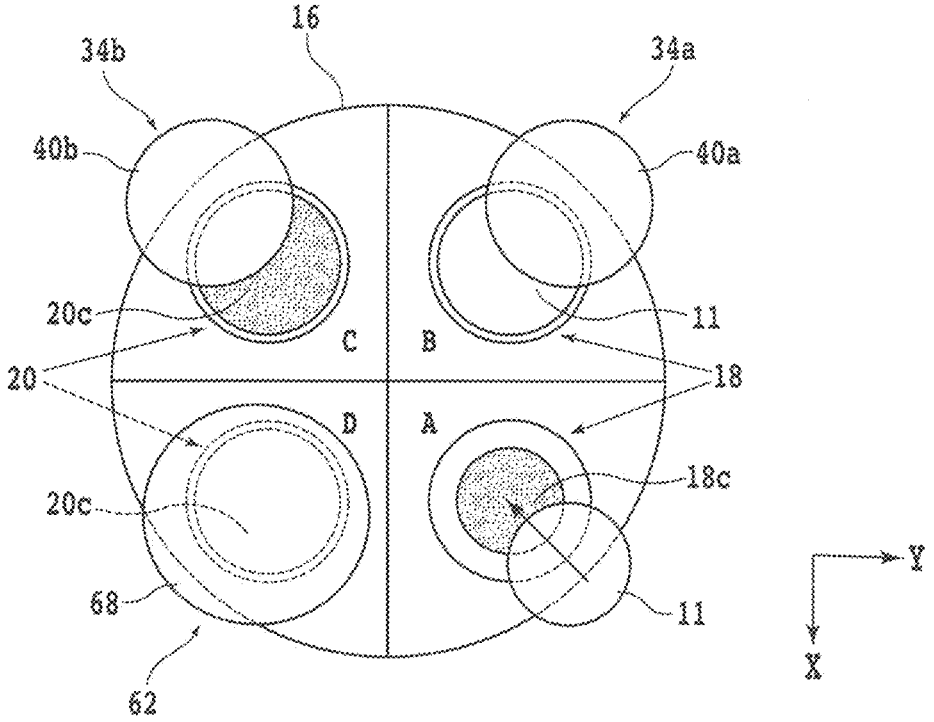
FIG. 5B is a plan view illustrating how a second piece of the wafer is conveyed onto another first chuck table.

Next, the turntable 16 is rotated and the chuck table 18 that holds the first piece of the wafer 11 is disposed at the first grinding position B. In addition, the other chuck table 18 is disposed at the conveyance position A. Then, a second piece of the wafer 11 housed in the cassette 8 is conveyed onto the chuck table 18 disposed at the conveyance position A and the second piece of the wafer 11 is held by this chuck table 18. FIG. 5B is a plan view illustrating how the second piece of the wafer 11 is conveyed onto the chuck table 18. When the first chuck table covering step is executed in this manner, the holding surfaces 18*c* of the two chuck tables 18 are each covered by the wafer 11.

Next, the wafers 13 are conveyed onto the chuck tables 20 and the wafers 13 held by the chuck tables 20 are ground by the grinding units 34*a* and 34*b* and thereafter the wafers 13 are conveyed from the chuck tables 20 (second wafer grinding step). In the second wafer grinding step, first, a first piece of the wafer 13 is conveyed from the cassette 8 to the position adjustment mechanism 12 by the conveyance unit 6 and position adjustment of the first piece of the wafer 13 is executed by the position adjustment mechanism 12.

Figure 6A:
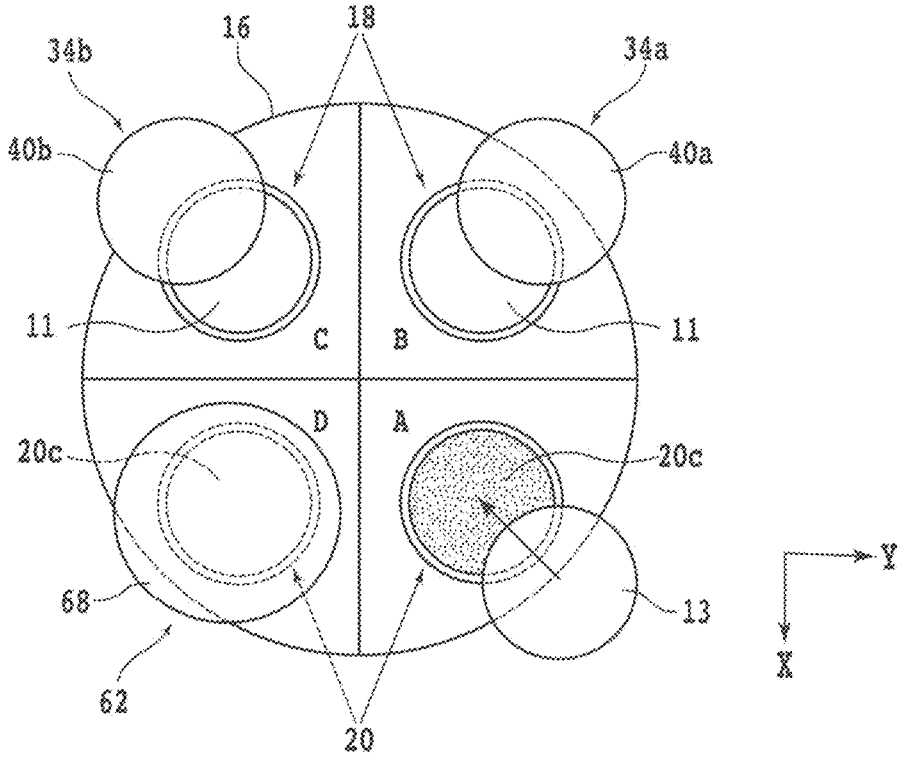
FIG. 6A is a plan view illustrating how a first piece of a wafer is conveyed onto one second chuck table.

Furthermore, the turntable 16 is rotated and the two chuck tables 18 are positioned to the first grinding position B and the second grinding position C. In addition, the two chuck tables 20 are positioned to the conveyance position A and the polishing position D. Then, the first piece of the wafer 13 is conveyed from the position adjustment mechanism 12 onto the chuck table 20 disposed at the conveyance position A by the conveyance unit 14 and the first piece of the wafer 13 is sucked and held by this chuck table 20. FIG. 6A is a plan view illustrating how the first piece of the wafer 13 is conveyed onto the chuck table 20. The first piece of the wafer 13 is disposed on the chuck table 20 to cover the whole of the holding surface 20*c*. Then, a negative pressure of the suction source is caused to act on the holding surface 20*c* of the chuck table 20 and the first piece of the wafer 13 is sucked and held by the chuck table 20.

Next, the turntable 16 is rotated and the chuck table 20 that holds the first piece of the wafer 13 is disposed at the first grinding position B. In addition, the other chuck table 20 is disposed at the conveyance position A. Then, the first piece of the wafer 13 held by the chuck table 20 positioned at the first grinding position B is ground by the grinding unit 34*a*. Specifically, in the state in which the chuck table 20 that holds the wafer 13 and the grinding wheel 40*a* of the grinding unit 34*a* are each rotated at a predetermined rotation speed, the grinding unit 34*a* is lowered and the plural grinding abrasive stones that the grinding wheel 40*a* has are brought into contact with the upper surface side of the first piece of the wafer 13. Thereby, the coarse grinding is executed for the upper surface side of the first piece of the wafer 13. This coarse grinding is continued until the thickness of the first piece of the wafer 13 becomes a predetermined thickness.

Figure 6B:
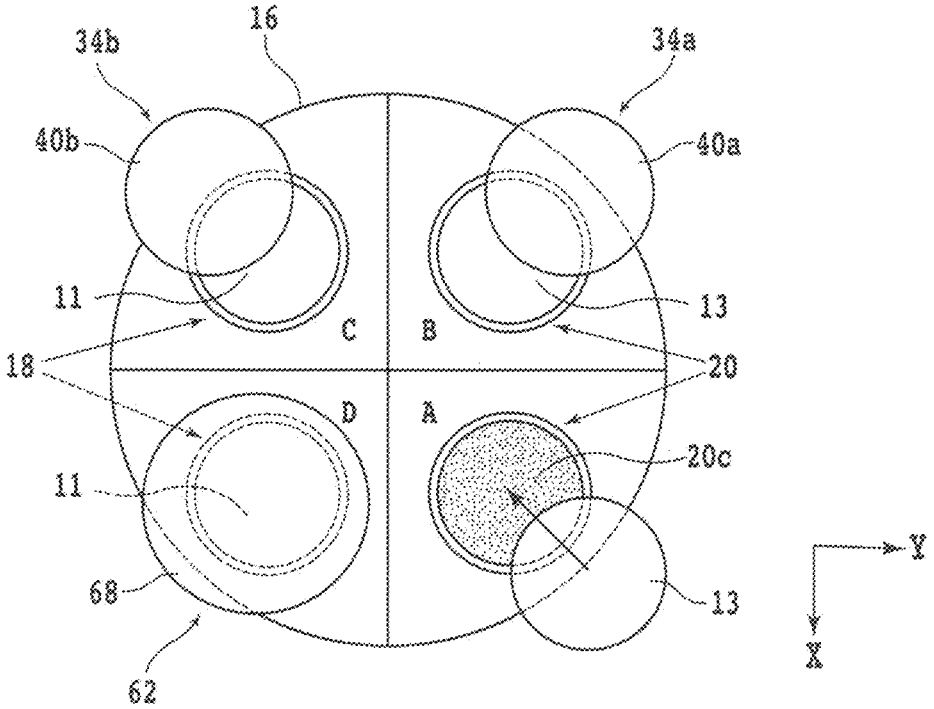
FIG. 6B is a plan view illustrating how a second piece of the wafer is conveyed onto another second chuck table.

Furthermore, in the grinding of the first piece of the wafer 13 by the grinding unit 34*a*, a second piece of the wafer 13 housed in the cassette 8 is conveyed onto the chuck table 20 disposed at the conveyance position A and the second piece of the wafer 13 is held by this chuck table 20. FIG. 6B is a plan view illustrating how the second piece of the wafer 13 is conveyed onto the chuck table 20. The procedure when the second piece of the wafer 13 is conveyed from the cassette 8 onto the chuck table 20 is the same as conveyance of the first piece of the wafer 13.

Figure 7A:
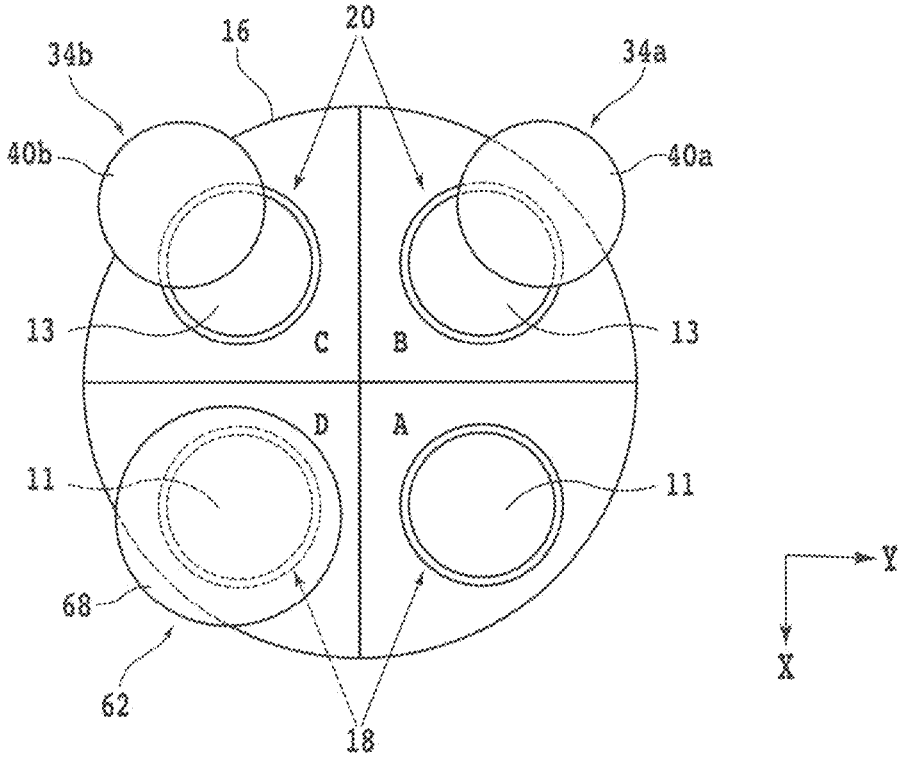
FIG. 7A is a plan view illustrating the state in which two second chuck tables are disposed at grinding positions.

Next, the turntable 16 is rotated and the chuck table 20 that holds the first piece of the wafer 13 is disposed at the second grinding position C. In addition, the chuck table 20 that holds the second piece of the wafer 13 is disposed at the first grinding position B. FIG. 7A is a plan view illustrating the state in which the two chuck tables 20 are disposed at the grinding positions (the first grinding position and the second grinding position). Then, the first piece of the wafer 13 held by the chuck table 20 positioned at the second grinding position C is ground by the grinding unit 34*b*. Specifically, in the state in which the chuck table 20 that holds the first piece of the wafer 13 and the grinding wheel 40*b* of the grinding unit 34*b* are each rotated at a predetermined rotation speed, the grinding unit 34*b* is lowered and the plural grinding abrasive stones that the grinding wheel 40*b* has are brought into contact with the upper surface side of the first piece of the wafer 13. Thereby, the finishing grinding is executed for the upper surface side of the first piece of the wafer 13. This finishing grinding is continued until the thickness of the first piece of the wafer 13 becomes a predetermined thickness. Furthermore, the second piece of the wafer 13 held by the chuck table 20 positioned at the first grinding position B is ground by the grinding unit 34*a*. The procedure when the second piece of the wafer 13 is ground by the grinding unit 34*a* is the same as the case of the grinding of the first piece of the wafer 13. Thereby, the coarse grinding is executed for the upper surface side of the second piece of the wafer 13.

Next, the turntable 16 is rotated and the chuck table 20 that holds the first piece of the wafer 13 is disposed at the polishing position D. In addition, the chuck table 20 that holds the second piece of the wafer 13 is disposed at the second grinding position C. Then, the first piece of the wafer 13 held by the chuck table 20 positioned at the polishing position D is polished by the polishing unit 62. Specifically, in the state in which the chuck table 20 that holds the first piece of the wafer 13 and the polishing pad 68 of the polishing unit 62 are each rotated, the polishing unit 62 is lowered and the polishing layer that the polishing pad 68 has is brought into contact with the upper surface side of the first piece of the wafer 13. Thereby, the upper surface side of the first piece of the wafer 13 is polished. This polishing is continued until the thickness of the first piece of the wafer 13 becomes a predetermined thickness. Furthermore, the second piece of the wafer 13 held by the chuck table 20 positioned at the second grinding position C is ground by the grinding unit 34*b*. The procedure when the second piece of the wafer 13 is ground by the grinding unit 34*b* is the same as the case of the grinding of the first piece of the wafer 13. Thereby, the finishing grinding is executed for the upper surface side of the second piece of the wafer 13.

Figure 7B:
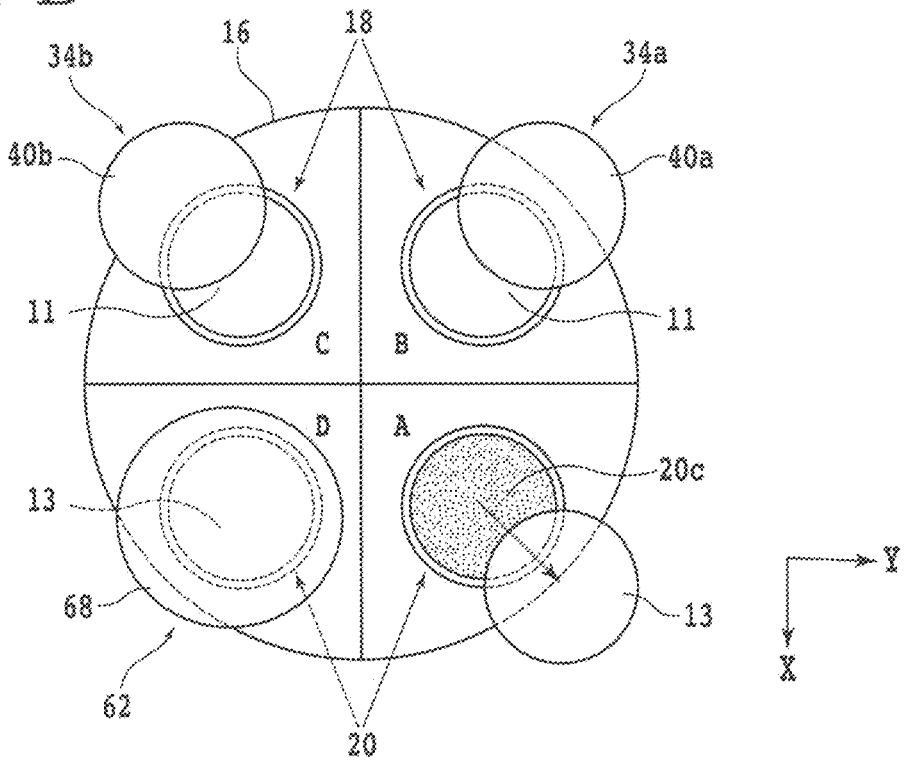
FIG. 7B is a plan view illustrating how the first piece of the wafer is conveyed from one second chuck table.

Next, the turntable 16 is rotated and the chuck table 20 that holds the first piece of the wafer 13 is disposed at the conveyance position A. In addition, the chuck table 20 that holds the second piece of the wafer 13 is disposed at the polishing position D. Then, the first piece of the wafer 13 is conveyed from the chuck table 20 positioned at the conveyance position A. FIG. 7B is a plan view illustrating how the first piece of the wafer 13 is conveyed from the chuck table 20. The first piece of the wafer 13 held by the chuck table 20 positioned at the conveyance position A is conveyed from the chuck table 20 to the cleaning unit 74 (see FIG. 1) by the conveyance unit 72 (see FIG. 1) and is cleaned. Then, after the cleaning by the cleaning unit 74, the first piece of the wafer 13 is conveyed to the cassette 10 by the conveyance unit 6. Furthermore, the second piece of the wafer 13 held by the chuck table 20 positioned at the polishing position D is polished by the polishing unit 62. The procedure when the second piece of the wafer 13 is polished by the polishing unit 62 is the same as the case of polishing by the first piece of the wafer 13. Thereby, the polishing processing is executed for the upper surface side of the second piece of the wafer 13.

Next, the turntable 16 is rotated and the chuck table 20 that holds the second pieces of the wafer 13 is disposed at the conveyance position A. Then, the second piece of the wafer 13 is conveyed from the chuck table 20 disposed at the conveyance position A by the conveyance unit 72 and is conveyed to the cassette 10 by the same procedure as the first piece of the wafer 13.

It is also possible to execute the above-described second wafer grinding step plural times consecutively. That is, if three or more wafers 13 are housed in the cassette 8 (see FIG. 1), third and subsequent pieces of the wafers 13 may be processed with keeping of the state in which the holding surfaces 18*c* of the chuck tables 18 are covered by the wafers 11.

Specifically, after the first piece of the wafer 13 that has been processed is conveyed from the chuck table 20 disposed at the conveyance position A by the conveyance unit 72, subsequently the third piece of the wafer 13 is conveyed onto this chuck table 20 by the conveyance unit 14. Then, the third piece of the wafer 13 is processed by the grinding units 34*a* and 34*b* and the polishing unit 62. Thereafter, the third piece of the wafer 13 that has been processed is conveyed from the chuck table 20 by the conveyance unit 72. Furthermore, after the second piece of the wafer 13 that has been processed is conveyed from the chuck table 20 disposed at the conveyance position A by the conveyance unit 72, subsequently a fourth piece of the wafer 13 is conveyed onto this chuck table 20 by the conveyance unit 14. Then, the fourth piece of the wafer 13 is processed by the grinding units 34*a* and 34*b* and the polishing unit 62. In a similar manner, processing is executed also for fifth and subsequent wafers 13.

In the above-described second wafer grinding step, in the state in which the holding surfaces 18*c* of the chuck tables 18 are covered by the wafers 11, the wafers 13 are held by the chuck tables 20 and are processed by the grinding units 34*a* and 34*b* and the polishing unit 62. Thus, even when processing dust generated in the processing of the wafers 13 is scattered inside the cover 70, adhesion of the processing dust to the holding surface 18*c* of the chuck table 18 and accumulation of the processing dust inside the chuck table 18 are prevented. Then, when processing of all wafers 13 housed in the cassette 8 is completed, the wafers 11 are conveyed from the chuck tables 18. Specifically, the wafer 11 held by the chuck table 18 positioned at the conveyance position A is conveyed to the cleaning unit 74 by the conveyance unit 72 and is cleaned. Then, after the cleaning by the cleaning unit 74, the wafer 11 is conveyed to the cassette 10 by the conveyance unit 6.

As described above, the grinding apparatus 2 according to the present embodiment includes plural chuck tables that can hold wafers different in size or shape. Thus, plural kinds of wafers can be processed without executing replacement work of the chuck table. This can omit the replacement work of the chuck table and intend improvement in the processing efficiency of the wafer. Furthermore, in the use method of the grinding apparatus 2 according to the present embodiment, the holding surface of the chuck table that does not hold the wafer as the processing target (chuck table in an unused state) is covered by the wafer for covering. Due to this, adhesion of the processing dust to the holding surface of the chuck table in the unused state and accumulation of the processing dust inside the chuck table in the unused state are prevented.

In the present embodiment, the example is described in which the wafers for covering (wafers 11) that cover the holding surfaces 18*c* of the chuck tables 18 are housed in the cassette 8. However, if the wafers to be processed by the grinding apparatus 2 are held by the chuck tables 18, the wafers for covering that cover the holding surfaces 20*c* of the chuck tables 20 are housed in the cassette 8. Furthermore, in the cassette 8, both the wafers for covering that cover the holding surfaces 18*c* of the chuck tables 18 and the wafers for covering that cover the holding surfaces 20*c* of the chuck tables 20 may be housed.

Furthermore, in the present embodiment, the example is described in which two kinds of chuck tables 18 and 20 different in the size and shape of the wafer that can be held are disposed. However, there is no limit to the number of kinds of chuck tables disposed on the turntable 16. That is, three or more kinds of chuck tables may be disposed on the turntable 16. For example, three kinds of chuck tables that can hold wafers with sizes and shapes different from each other may be disposed on the turntable 16 in such a manner that one chuck table is disposed per one kind. The number of kinds of wafers for covering housed in the cassette 8 is set according to the number of kinds of chuck tables disposed on the turntable 16. For example, if three kinds of chuck tables are disposed on the turntable 16, at least two kinds of wafers for covering that can cover each of the holding surfaces of two kinds of chuck tables that do not hold the wafer as the processing target are housed in the cassette 8.

Moreover, in the cassette 8, one kind of wafer for covering that can hold the holding surfaces of all kinds of chuck tables disposed on the turntable 16 may be housed. For example, the wafer for covering having the same diameter as the wafer with the largest diameter in the wafers that can be processed by the grinding apparatus 2 is housed in the cassette 8. Then, the holding surfaces of all chuck tables that do not hold the wafer as the processing target are covered by this wafer for covering. Specifically, the wafer 11 that covers the holding surface 18*c* of the chuck table 18 (see FIG. 4A) may have size and shape that allow covering of the holding surface 20*c* of the chuck table 20. For example, the diameter of the wafer 11 may be equal to or larger than the diameter of the wafer 13 that is held by the chuck table 20 and is processed. In this case, the wafer 11 can cover both the holding surface 18*c* of the chuck table 18 and the holding surface 20*c* of the chuck table 20. In the case of covering the holding surface 18*c* whose diameter $\varphi_1$ is small (see FIG. 4A) by the wafer 11 with a large diameter like the above-described one, the region that does not get contact with the holding surface 18*c* in the peripheral part of the wafer 11 is large and the strength of holding of the wafer 11 by the chuck table 18 is weakened. However, processing is not executed for the wafer 11 and the wafer 11 does not get contact with the grinding wheels 40*a* and 40*b* and the polishing pad 68. Thus, the state in which the wafer 11 is held by the chuck table 18 is sufficiently kept by suction of the holding surface 18*c*.

Furthermore, the wafer for covering does not necessarily need to be housed in the cassette 8. For example, in addition to the cassette 8 in which wafers before processing are housed and the cassette 10 in which wafers that have been processed are housed, a cassette in which the wafers for covering are housed may be separately disposed. In this case, the cassette in which the wafers for covering are housed is placed near the conveyance unit 6, for example, and the wafer for covering is conveyed to the position adjustment mechanism 12 by the conveyance unit 6.

Moreover, in the present embodiment, the case in which the grinding apparatus 2 includes the grinding units 34*a* and

34*b* and the polishing unit 62 is described. However, the polishing unit 62 can be omitted if the polishing processing of a wafer is executed by a dedicated apparatus (polishing apparatus) separately prepared. Furthermore, in the present embodiment, the case is described in which the grinding apparatus 2 includes two sets of grinding units 34*a* and 34*b* and can execute two kinds of grinding processing (coarse grinding processing and finishing grinding processing). However, the grinding unit included in the grinding apparatus 2 may be one set.

Besides, structures, methods, and so forth according to the above-described embodiment can be carried out with appropriate changes without departing from the range of the object of the present invention.

The present invention is not limited to the details of the above described preferred embodiment. The scope of the invention is defined by the appended claims and all changes and modifications as fall within the equivalence of the scope of the claims are therefore to be embraced by the invention.

What is claimed is:

1. A grinding apparatus comprising:

a first chuck table that has a first frame body and a first porous member that includes a first porous holding surface corresponding to a first wafer and holds the first wafer;

a second chuck table that has a second frame body and a second porous member that includes a second porous holding surface corresponding to a second wafer different from the first wafer in size or shape and holds the second wafer, wherein the second porous member is different in size or shape from the first porous member;

a turntable that supports each of the first chuck table and the second chuck table in a rotatable state and positions the first chuck table to a conveyance position to which the first wafer is conveyed and a grinding position at which the first wafer is ground and positions the second chuck table to the conveyance position to which the second wafer is conveyed and the grinding position at which the second wafer is ground; and a grinding unit that grinds, by a grinding wheel, the first wafer sucked and held by the first chuck table positioned at the grinding position or the second wafer sucked and held by the second chuck table positioned at the grinding position.

2. A grinding apparatus comprising:

a pair of first chuck tables, wherein each of said first chuck tables has a first frame body and a first porous member that includes a first porous holding surface corresponding to a first wafer and configured to hold the first wafer, wherein each of the first porous members has a circular disc shape of a first diameter and each of the first porous holding surfaces extends from a center of the associated first porous member to an inner circumferential edge of the associated first frame body;

a pair of a second chuck tables, wherein each of said second chuck tables has a second frame body and a second porous member that includes a second porous holding surface corresponding to a second wafer different from the first wafer in size and configured to hold the second wafer, wherein each of the second porous members has a circular disc shape of a second diameter and each of the second porous holding surfaces extends from a center of the associated second porous member to an inner circumferential edge of the associated second frame body, and further wherein the second diameter is different from the first diameter;

a turntable that supports the first chuck tables and the second chuck tables in a rotatable state and positions one of the first chuck tables to a conveyance position to which the first wafer is conveyed and a grinding position at which the first wafer is ground and positions one of the second chuck table to the conveyance position to which the second wafer is conveyed and the grinding position at which the second wafer is ground; and a grinding unit that grinds, by a grinding wheel, the first wafer sucked and held by one of the first chuck tables positioned at the grinding position or the second wafer sucked and held by one of the second chuck tables positioned at the grinding position.

3. A grinding apparatus comprising:

a first chuck table that has a first frame body and a first porous member that includes a first porous holding surface corresponding to a first wafer and holds the first wafer, wherein the first porous member has a circular disc shape of a first diameter and the first porous holding surface extends from a center of the first porous member to an inner circumferential edge of the first frame body;

a second chuck table that has a second frame body and a second porous member that includes a second porous holding surface corresponding to a second wafer different from the first wafer in size or shape and holds the second wafer, wherein the second porous member has a circular disc shape of a second diameter and the second porous holding surface extends from a center of the second porous member to an inner circumferential edge of the second frame body, and further wherein the second diameter of the second porous member is different from the first diameter of the first porous member;

a turntable that supports each of the first chuck table and the second chuck table in a rotatable state and positions the first chuck table to a conveyance position to which the first wafer is conveyed and a grinding position at which the first wafer is ground and positions the second chuck table to the conveyance position to which the second wafer is conveyed and the grinding position at which the second wafer is ground; and a grinding unit that grinds, by a grinding wheel, the first wafer sucked and held by the first chuck table positioned at the grinding position or the second wafer sucked and held by the second chuck table positioned at the grinding position.

* * * * *